United States Patent [19]

Schiel et al.

[11] 4,016,033

[45] Apr. 5, 1977

[54] DISTRIBUTION MEANS FOR AQUEOUS SLURRY IN PAPERMAKING MACHINES

[75] Inventors: Christian Schiel; Dieter Egelhof; Karl Wolf, all of Heidenheim, Germany

[73] Assignee: J. M. Voith GmbH, Heidenheim, Germany

[22] Filed: Feb. 23, 1976

[21] Appl. No.: 660,705

[30] Foreign Application Priority Data

Mar. 1, 1975 Germany ..... 2508929

[52] U.S. Cl. ..... 162/343; 162/338; 162/344; 137/561 A

[51] Int. Cl.[2] ..... D21F 1/06

[58] Field of Search ..... 162/343, 344, 336, 338, 162/212, 216; 137/561 A

[56] References Cited

UNITED STATES PATENTS

| | | | |
|---|---|---|---|
| 3,272,233 | 9/1966 | Trufitt | 162/343 |
| 3,445,331 | 5/1969 | Lee et al. | 162/343 |
| 3,535,203 | 10/1970 | Nilsson | 162/343 |
| 3,794,056 | 2/1974 | Warren | 137/561 A |
| 3,843,470 | 10/1974 | Betley et al. | 162/343 |
| 3,846,229 | 11/1974 | Kallmes | 162/343 |
| 3,923,593 | 12/1975 | Verseput | 162/343 |
| 3,945,882 | 3/1976 | Egelhof et al. | 162/343 |

*Primary Examiner*—Robert L. Lindsay, Jr.
*Assistant Examiner*—George C. Yeung
*Attorney, Agent, or Firm*—Peter K. Kontler; John Kurucz

[57] ABSTRACT

Stock distribution means for delivering an aqueous slurry in a papermaking machine has a tapering passage which delivers stock to a nozzle by way of several rows of channels whose inlets are in communication with the passage. The passage, the entire channels and/or the inlets of the channels are configurated and dimensioned in such a way that the resistance which the inlets nearer to the intake end of the passage offer to the inflow of stock is more pronounced than the resistance of inlets which are more distant from such intake end. This insures uniformity or substantial uniformity of the volume of stock flow in each channel in spite of the fact that the channels of neighboring rows are at least partially inclined with respect to each other and that the inlets of channels in successive rows are located downstream of each other, as considered in the direction of stock flow in the passage.

8 Claims, 9 Drawing Figures

DISTRIBUTION MEANS FOR AQUEOUS SLURRY IN PAPERMAKING MACHINES

BACKGROUND OF THE INVENTION

The present invention relates to papermaking machines in general, and more particularly to improvements in stock distribution means for delivering an aqueous papermaking slurry of fiber furnish or the like in a papermaking machine. More particularly, the invention relates to improvements in stock distribution means of the type wherein a manifold or an analogous stream dividing device supplies stock (i.e., an aqueous slurry) to a plurality of distributor tubes or conduits which feed stock into a tapering passage having a width equal to or approximating the width of the paper web which is formed in the papermaking machine. In such stock distribution means, the passage serves to deliver stock to the orifice of a nozzle (e.g., a nozzle of the type disclosed in Canadian Pat. No. 614,901 granted Feb. 21, 1961 to David R. Webster) by way of several groups (preferably rows) of channels each having an inlet in communication with the passage and an outlet arranged to direct a jet of stock into the orifice of the nozzle. If the stock distribution means comprises three groups or rows of channels, the inlets of a first row of channels communicate with the passage upstream of the inlets of a second row, and the inlets of such second row communicate with the passage upstream of the inlets of the third row. Furthermore, at least a portion of each channel in the first and third rows converges toward the channels of the second row, and the channels are inclined with respect to the aforementioned distributor conduits which supply stock to the passage.

The quality (especially uniformity) of the web which is formed in a papermaking machine is improved if each group or row of channels receives the same quantity of stock. This can be achieved if the losses of stock flow in the inlets of all channels are the same. German Pat. No. 2,039,293 discloses a stock distribution means wherein losses of stock flow in the inlets of all channels are identical; however, the rate or volume of stock flow in various rows of channels is different because the inclination of channels with respect to the passage differs from row to row. Since the overall losses of liquid flow in a channel include losses at the inlet and losses which are attributable to inclination of the channel with respect to the direction of liquid flow in the passage, losses of liquid flow in the stock distribution means of the type disclosed in the aforementioned German patent vary from row to row. As a rule, such losses are less pronounced in the row of channels whose inlet communicate with the passage upstream of the inlets of the other row or rows of channels because losses due to inclination of channels increase from row to row as considered in the direction of liquid flow in the passage. Therefore, the just discussed stock distribution means is incapable of insuring uniform volume of stock flow in all channels.

German Auslegeschrift No. 2,307,849 discloses another distribution means wherein the inlets of channels are bounded by convex surfaces and the surface bounding the passage opposite the inlets of the channels is curved in such a way that the inclination of each channel with respect to the stream of stock flowing in the passage along the respective convex surface is constant. This insures that the inclination (bend) of all channels is identical. Since the losses at the inlets are also identical or nearly identical, such stock distribution means constitutes an improvement over that which is disclosed in the aforementioned German patent. However, the cost of stock distribution means of the type disclosed in German Auslegeschrift No. 2,307,849 is very high.

SUMMARY OF THE INVENTION

An object of the invention is to provide a novel and improved stock distribution means for use in papermaking machines which is simpler and less expensive than heretofore known stock distribution means but is capable of insuring uniformity of the volume of stock flow in each of several groups (e.g., rows) of channels which connect a central passage of the stock distribution means with the orifice of a stock discharging nozzle or the like.

Another object of the invention is to provide a novel and improved system of channels and a novel and improved central passage in a stock distribution means of the just outlined character.

A further object of the invention is to provide a stock distribution means wherein the identity or uniformity of the volume of stock flow in all channels is insured by a novel design of the channels and/or by a novel design of the passage which supplies stock to the channels.

An additional object of the invention is to provide a novel and improved stock distribution means which can be utilized in or combined with existing papermaking machines.

The invention is embodied in a stock distribution means for delivering an aqueous slurry in a papermaking machine, especially in a stock distribution means wherein a manifold or another suitable stream dividing device supplies stock to a plurality of distributor conduits which supply stock to a passage serving to deliver stock to the orifice of a nozzle or the like by way of at least two groups of channels each having an inlet in communication with the passage and an outlet arranged to direct stock into the orifice. The inlets of one of the groups of channels communicate with the passage upstream of the inlets of the other group of channels. The width of the passage preferably equals or approximates the width of the paper web which is formed in the papermaking machine; the channels are preferably inclined with respect to the distributor conduits; and at least a portion of each channel of the one group converges toward the channels of the other group, as considered in the direction in which the stock is fed from the passage toward the orifice.

The improvement resides in that the resistance of the inlets of the one group of channels to the flow of stock from the passage into the channels of the one group exceeds the resistance of the inlets of the channels of the other group. This can be achieved in a number of ways, for example, by dimensioning the inlets of the other group of channels in such a way that their cross-sectional areas exceed the cross-sectional areas of the inlets of the one group of channels, by dimensioning each channel of the other group in such a way that its cross-sectional area exceeds the cross-sectional areas of channels of the one group, or by resorting to a passage whose cross-sectional area varies in the direction of stock flow therein so that the speed of stock in the region of the inlets of the one group of channels exceeds the speed of stock flow in the region of the inlets of the other group of channels.

The novel features which are considered as characteristic of the invention are set forth in particular in the appended claims. The improved stock distribution means itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
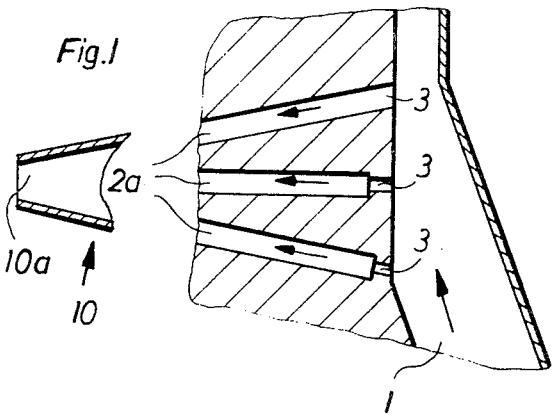
FIG. 1 is a fragmentary sectional view of a stock distribution means which embodies one form of the invention.
Figure 2:
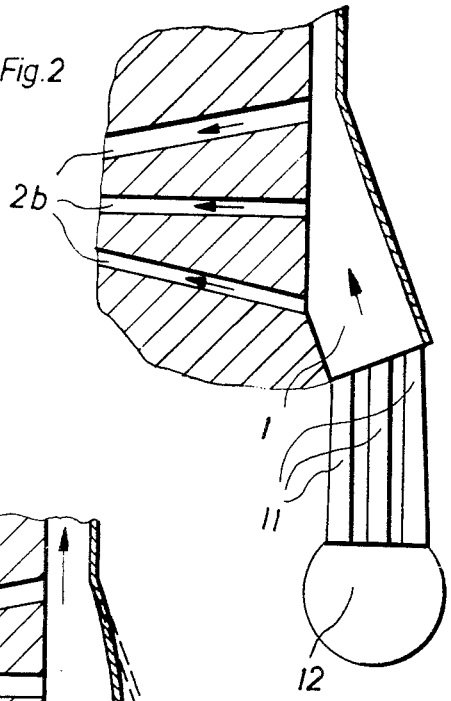
FIG. 2 is a similar fragmentary sectional view of a second stock distribution means.

Referring first to FIG. 1, there is shown a stock distribution means which is designed for use in a papermaking machine and, in certain respects, resembles the stock distribution means of German Pat. No. 2,039,293. The stock distribution means of FIG. 1 comprises a central stock feeding passage 1 whose width, as considered at right angles to the plane of the drawing, equals or approximates the width of the paper web which is formed in the papermaking machine. The lower or intake end of the passage 1 receives stock (e.g., an aqueous papermaking slurry of fiber furnish) from several distributor conduits (e.g., pipes) 11 one of which is shown in FIG. 2. The conduits 11 receive stock from a manifold 12 (FIG. 2) or an analogous stream dividing device.

The passage 1 communicates with and delivers stock into the inlets 3 of three groups or rows of elongated channels 2*a*. The outlets of these channels discharge stock into a nozzle or slice 10 having an orifice 10*a* which directs stock into the nip of one or/two endless screens (not shown) in the papermaking machine. Reference may be had, for example, to the aforementioned Canadian patent to Webster. The directions in which the stock flows in passage 1 and channels 2*a* are indicated by arrows.

Figure 8A:
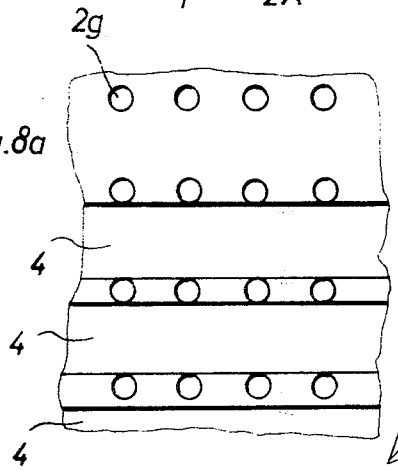
FIG. 8*a* is a view as seen in the direction of arrow VIII in FIG. 8.

In the embodiment of FIG. 1, the cross-sectional area of the inlet 3 of each median channel 2*a* exceeds the cross-sectional area of the inlets of the lowermost channels 2*a* and is less than the cross-sectional area of inlets 3 of the uppermost channels 2*a*. As shown in FIG. 8*a* (for the channels 2*g*), the lowermost channel 2*a* of FIG. 1 is one of a first group or row of channels, the median channel 2*a* of FIG. 1 is one of a second group or row of channels, and the upper channel 2*a* of FIG. 1 is one of a third group or row of channels. It will be noted that the cross-sectional areas of the inlets 3 increase in the direction of stock flow in the passage 1.

The channels 2*a* of the first and third rows converge toward the channels 2*a* of the second row, and the channels of all three rows are inclined with respect to the distributor conduits 11. The major portions of the channels 2*a* (save for the respective inlets 3) have identical diameters. The inlets 3 of the first and second rows of channels 2*a* constitute flow restrictors, and the inlets of the third row of channels may (but need not) have cross-sectional areas identical to those of the major portions of the first and second rows of channels. Owing to the just discussed dimensioning of inlets 3, the resistance which the inlets of the first row of channels offer to the flow of stock from the passage 1 into the first row of channels exceeds the resistance of the inlets of the second row of channels, and the resistance of the inlets of the second row of channels exceeds the resistance of the third row of channels.

As explained above, losses of fluid flow in a channel include losses which arise at the inlet and losses which are due to inclination (bend) of the channels. By the simple expedient of properly dimensioning the cross-sectional areas of the inlets 3, the stock distribution means which embodies the structure of FIG. 1 is capable of achieving uniformity of the volume of stock flow in all of the channels 2*a* in spite of the fact that the inclination of channels 2*a* in each of the three rows is different. In other words, the dimensions of the inlets 3 of the first row of channels 2*a* are selected with a view to insure that the volume of flow in the first row is identical with the volume of flow in the second row of channels in spite of the fact that the inlets 3 of the first row of channels 2*a* are located upstream of the other inlets and that the inclination of the first row of channels with respect to the direction of stock flow in the passage 1 is less pronounced than the inclination of channels forming the second and third rows. The same applies for the dimensions of inlets 3 of the second row of channels 2*a*, i.e., these inlets are dimensioned with a view to insure uniformity of the volume of stock flow in channels of the second and third rows in spite of the fact that the inlets of channels in the second row are located upstream of the inlets of the channels in the third row and that the inclination of channels in the third row is more pronounced than that of channels forming the second row. The throttling effect of inlets 3 of the second row of channels 2*a* is more pronounced than the throttling effect of inlets of the channels of the third row but is less pronounced than that of the inlets of the first row of channels.

In the embodiment of FIG. 2, the cross-sectional area of each channel 2*b* of the first (lowermost) row is constant from inlet to outlet and is less than the cross-sectional area of channels 2*b* of the second (median) row. Analogously, the cross-sectional area of each channel of the third (uppermost) row is greater than that of the channels forming the second row. The result is the same as in the embodiment of FIG. 2, i.e., by properly selecting the cross-sectional areas of the channels 2*b*, the volume of stock flow in all channels is the same in spite of the fact that the inlets of channels 2*b* forming the first and second rows are respectively located upstream of inlets of channels forming the second and third rows and also in spite of the fact that the inclination of channels forming the second and third rows with respect to the conduits 11 and the direction of stock flow in the passage 1 respectively exceeds the inclination of channels forming the first and second rows.

Figure 3:
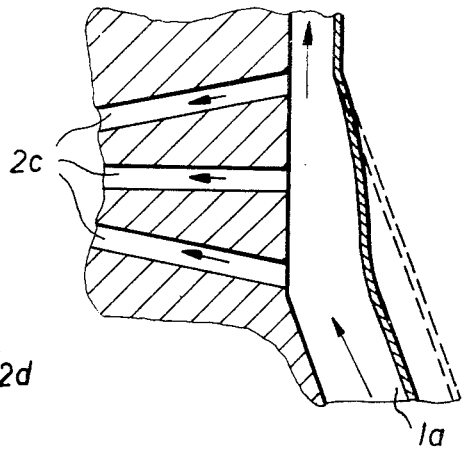
FIG. 3 is a fragmentary sectional view of a third stock distribution means.

FIG. 3 illustrates a portion of a stock distribution means wherein uniformity of volume of stock flow in all channels 2*c* (whose cross-sectional areas are assumed to be identical from inlet to outlet) is achieved by changing the cross-sectional area of the passage. The rear wall of a passage corresponding to those shown in FIGS. 1 and 2 is indicated by broken lines. The modified passage 1*a* of FIG. 3 is configurated in such a way that its cross-sectional area varies in the direction of stock flow therein in order to insure that the speed of stock flow in the region of inlets of the first (lowermost) row of channels 2*c* is greater than in the region of inlets of the second row of channels, and the speed of stock flow in the region of inlets of the third (uppermost) row of channels 2*c* is less than in the region of inlets of the second row of channels. As shown, the construction of the passage 1*a* (as considered at right angles to the direction of stock flow) is more pronounced than the constriction of the passage 1. The result is the same as in the embodiment of FIG. 1 or 2.

It will be noted that, whereas the stock distribution means of FIGS. 1 and 2 insure uniformity of the volume of stock flow in all channels 2*a* or 2*b* by proper dimensioning of selected portions of or entire channels, the stock distribution means of FIG. 3 insures such uniformity by appropriate dimensioning and shaping of the passage 1*a*. The direction of stock flow in the passage 1*a* is normal or substantially normal to the direction of stock flow in the channels 2*c*. The inclination of channels 2*c* forming the first, second and third rows with respect to each other is identical with or similar to that of the channels 2*a* or 2*b*.

As a rule, the cross-sectional area of the passage (such as the passage 1 of FIG. 1) varies in accordance with a predetermined pattern. The rate at which the cross-sectional area of the passage varies in the direction of stock flow therein is determined by the desired volume of stock flow in the channels. By reducing the cross-sectional area of the passage in a manner as shown in FIG. 3, i.e., by reducing it at a rate exceeding the accustomed rate, the speed of stock flow in the passage increases while the pressure decreases. This, in turn, insures that, when compared with a non-accelerated stock stream, the quantity of stock which enters the inlets of the channels is reduced. Thus, by properly changing the cross-sectional area of the passage so that it deviates from the accustomed cross-sectional area, one can compensate for the fact that the channels of the several rows are differently inclined with respect to the direction of stock flow in the passage and also that the inlets of successive rows of channels are located downstream of each other. The result is that the volume of stock flow in each channel 2*c* is the same.

Figure 4:
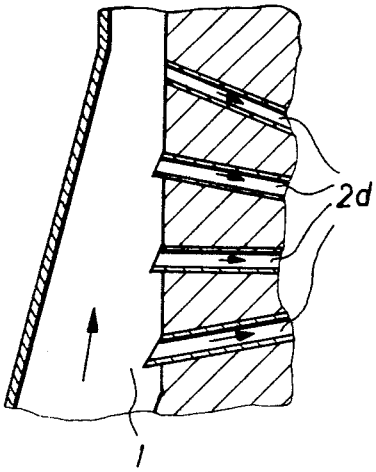
FIG. 4 is a fragmentary sectional view of a fourth stock distribution means.
Figure 5:
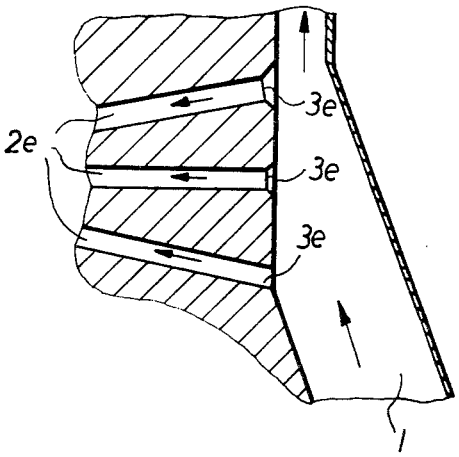
FIG. 5 is a fragmentary sectional view of a fifth stock distribution means.
Figure 6:
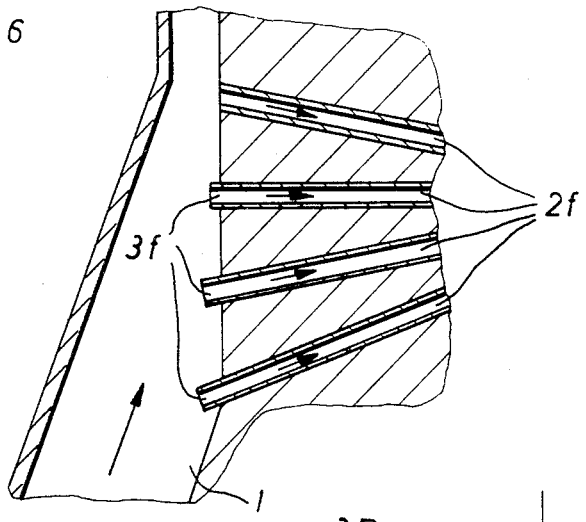
FIG. 6 is a fragmentary sectional view of a sixth stock distribution means.
Figure 7:
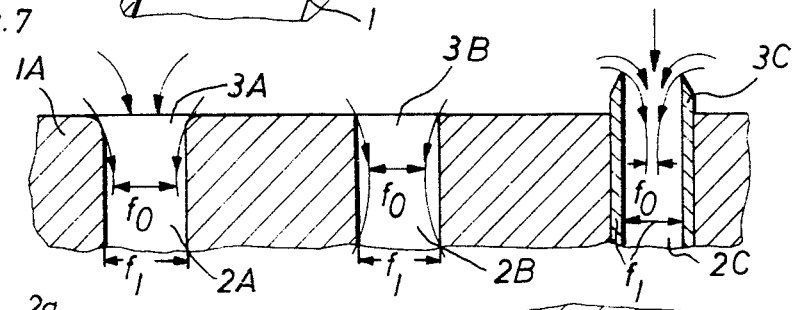
FIG. 7 is a larger-scale sectional view of several channels having different inlets, and further showing the effect of the configuration of inlets upon the flow of stock into the respective channels.

Prior to describing the embodiments of FIGS. 4, 5 and 6, reference will be had to FIG. 7 which shows a portion of a stock distribution means having three different channels 2A, 2B and 2C. The so-called contraction value or factor alpha equals $f_0/f_1$ wherein $f_0$ is the effective cross-sectional area of a channel and $f_1$ is the actual cross-sectional area of the inlet of the channel.

The inlet 3A of the leftmost channel 2A of FIG. 7 is chamfered, i.e., it is bounded by a convex annular surface so that it diverges toward the passage 1 or 1*a* which is assumed to be located above the inlet 3A, as viewed in FIG. 7. It will be noted that the effective cross-sectional area $f_0$ of the channel 2A almost equals the area $f_1$, i.e., the rate at which a stream of stock flows from the passage into the channel 2A is very high.

The inlet 3B of the median channel 2B of FIG. 7 is bounded by a circular cylindrical surface which forms a pronounced circular edge with a surface 1A bounding the front side of the passage. The effective cross-sectional area $f_0$ of the channel 2B is less than that of the channel 2A.

The channel 2C is a conduit or tube having an inlet 3C which extends beyond the surface 1A, i.e., into the stream of stock in the passage. The effective cross-sectional area $f_0$ of the channel 2C is only a small fraction of that of the channel 2A or 2B even though the actual cross-sectional area $f_1$ of the channel 2C equals or approximates that of the channel 2A or 2B. It will be seen that the contraction factor alpha is greater if the respective channel offers less resistance to the flow of a fluid (which may be a liquid or a gaseous substance). It will also be seen that an inlet which exhibits a sharp edge reduces the rate of inflow of fluid, and that an inlet which extends into the stream of fluid in the passage effects an even more pronounced reduction of the rate of fluid flow into the respective channel.

The just discussed contraction factor can be utilized, in a manner to be described in connection with FIGS. 4, 5 and 6, in order to achieve the same result as in the embodiments of FIGS. 1 to 3, i.e., to insure that the volume of stock flow in each of several rows or groups of channels is the same.

In the embodiment of FIG. 4, the channels 2*d* are tubular bodies whose inlets extend into the passage 1 to a different extent. Thus, the extent to which the inlets of the first or lowermost row of channels 2*d* project into the passage 1 exceeds the extent to which the inlets of the second row of channels 2*d* project into the passage, and so forth. The inlets of the fourth or uppermost row of channels 2*d* need not extend into the passage 1. The embodiment of FIG. 4 utilizes channels which are analogous to the channel 2C of FIG. 7. The end faces of the inlets of channels 2*d* are not normal to the axes of the respective channels.

The stock distribution means of FIG. 5 includes channels 2*e* whose inlets 3*e* diverge toward the passage 1 to a different extent. Thus, the inlets 3*e* of the first or lowermost row of channels 2*e* are similar to the inlet 3B of FIG. 7. The inlets 3*e* of the second and third rows of channels 2*e* are similar to the inlet 3A of FIG. 7; however, the maximum cross-sectional area of each inlet 3*e* in the third row is greater than the maximum cross-sectional area of each inlet 3*e* in the second row. It is clear that the inlets 3*e* of the lowermost row of channels 2*e* can also diverge toward the passage 1, as long as the extent of their divergence is less than that of inlets 3*e* in the second row.

In FIG. 6, the end faces of the inlets 3*f* of tubular channels 2*f* are normal or substantially normal to the axes of the respective channels. The identity of volume of stock flow in all channels 2*f* is achieved in a manner which is analogous to that described in connection with FIG. 4 and in reliance on the phenomenon which is described in connection with the channel 2C of FIG. 7. It will be noted that, whereas FIG. 4 shows a construction wherein only a portion of the circumference of a tubular channel in each of the three lower rows extends into the passage 1, the positioning of channels 2*f* in FIG. 6 is such that circumferentially complete portions of inlets 3*f* of the three lower rows of channels extend into the adjacent portion of the passage 1.

Figure 8:
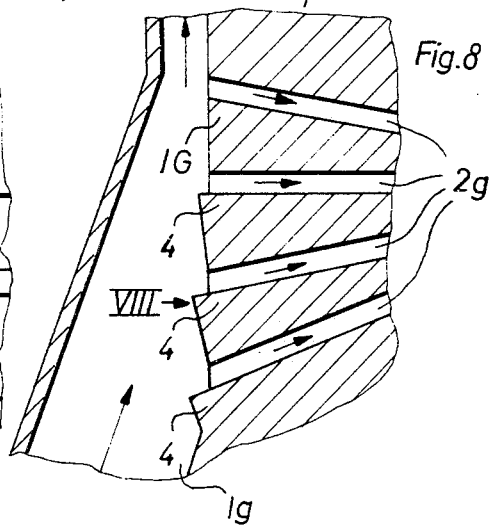
FIG. 8 is a fragmentary sectional view of a seventh stock distribution means.

Referring to FIGS. 8 and 8*a*, there is shown a stock distribution means with a modified passage 1*g* and channels 2*g* which convey stock from the passage toward the nozzle, not shown. The right-hand surface 1G of the passage 1*g* is stepped, as at 4, so that it forms several shoulders extending in parallelism with and immediately upstream of the neighboring rows of channels 2*g*. There is no shoulder immediately upstream of the uppermost row of channels 2*g*, and the shoulder 4 immediately upstream of the next-to-the-lowermost row of channels 2*g* is more pronounced than the uppermost shoulder but less pronounced than the lowermost shoulder.

The shoulders 4 effect partial deflection of the stream of stock from the inlets of the neighboring channels 2*g*. The extent of deflection depends on the dimensions of the respective shoulder, and this renders it possible to achieve uniformity of the volume of stock flow in all channels 2*g* in spite of the fact that the inlets of successive rows of channels are located downstream of each other and that the inclination of channels varies from row to row.

It is within the purview of the invention to combine the features of various embodiments with each other and also to rely on a modified passage (such as the passage of FIG. 3 or 8) in combination with channels of the type shown in FIG. 1, 2, 4, 5 or 6. Furthermore, the number of channels in each group or row and the number of groups or rows can be changed practically at will without departing from the spirit of the invention.

The exact configuration and/or dimensions of the passage, channels and/or their inlets can be determined empirically or by resorting to relatively simple calculations. The same applies for the inclination of channels with respect to each other and with respect to the distributor conduits. The aforementioned relatively simple experimentation and/or calculation must be carried out by considering the nature of stock to be fed in the papermaking machine, the surface finish of parts in the stock. distribution means and certain other factors familiar to those having necessary skill in the art of papermaking. All that counts is to insure that the volume of flow of stock in each of two or more groups of channels is identical or sufficiently uniform to insure the making of a superior paper web.

Without further analysis, the foregoing will so fully reveal the gist of the present invention that others can, by applying current knowledge, readily adapt it for various applications without omitting features which, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a stock distribution means for delivery of an aqueous slurry in a machine for forming a paper web, a combination comprising a stock-containing stream dividing device; conduits in communication with and receiving streams of stock from said dividing device; means defining a passage communicating with and receiving said streams from said conduits, said passage having a width which equals or approximates the width of the paper web which is formed in said machine; a slice having a discharge orifice; and means defining at least two groups of channels connecting said passage with said slice to deliver stock to said orifice, said channels being inclined with respect to said conduits and each of said channels having a stock-receiving inlet portion communicating with said passage and an outlet portion which discharges stock into said slice, the inlet portions of one group of said groups of channels communicating with said passage upstream of the inlet portions of the other group of said groups of channels and at least a portion of each channel of said one group converging toward the channels of said other group, as considered in the direction in which the stock is fed from said passage to said slice, the cross-sectional areas of inlet portions of said other group of channels exceeding the cross-sectional areas of inlet portions of said one group of channels whereby the inlet portions of said one group of channels offer a greater resistance to the flow of stock from said passage into the inlet portions of said one group of channels and a lower resistance to the flow of stock from said passage into the inlet portions of said other group of channels.

2. The combination of claim 1, wherein the cross-sectional areas of said other group of channels exceed the cross-sectional areas of said one group of channels.

3. The combination of claim 1, wherein the inlet portions of said other group of channels diverge in a direction toward said passage.

4. In a stock distribution means for delivery of an aqueous slurry in a machine for forming a paper web, a combination comprising a stock-containing stream dividing device; conduits in communication with and receiving streams of stock from said dividing device; means defining a passage communicating with and receiving said streams from said conduits, said passage having a width which equals or approximates the width of the paper web which is formed in said machine; a slice having a discharge orifice; and means defining at least two groups of channels connecting said passage with said slice to deliver stock to said orifice, said channels being inclined with respect to said conduits and each of said channels having a stock-receiving inlet portion communicating with said passage and an outlet portion which discharges stock into said slice, the inlet portions of one group of said groups of channels communicating with said passage upstream of the inlet portions of the other group of said groups of channels and at least a portion of each channel of said one group converging toward the channels of said other group, as considered in the direction in which the stock is fed from said passage to said slice, the cross-sectional area of said passage varying in the direction of stock flow therein so that the speed of stock in the region of the inlet portions of said one group of channels exceeds the speed of stock in the region of the inlet portions of said other group of channels and the quantity of stock flowing into the channels of said one group at least closely approximates the quantity of stock flowing into the channels of said group.

5. In a stock distribution means for delivery of an aqueous slurry in a machine for forming a paper web, a combination comprising a stock-containing stream dividing device; conduits in communication with and receiving streams of stock from said dividing device; means defining a passage communicating with and receiving said streams from said conduits, said passage having a width which equals or approximates the width of the paper web which is formed in said machine; a slice having a discharge orifice; and means defining at least two groups of channels connecting said passage with said slice to deliver stock to said orifice, said channels being inclined with respect to said conduits and each of said channels having a stock-receiving inlet portion communicating with said passage and an outlet portion which discharges stock into said slice, the inlet portions of one group of said groups of channels communicating with said passage upstream of the inlet portions of the other group of said groups of channels and at least a portion of each channel of said one group converging toward the channels of said other group, as considered in the direction in which the stock is fed from said passage to said slice, the inlet portions of said one group of channels extending into said passage whereby the inlet portions of said one group of channels offer a greater resistance to the flow of stock from said passage into the inlet portions of said one group of channels and a lower resistance to the flow of stock from said passage into the inlet portions of said other group of channels.

6. The combination of claim 5, wherein the inlet portions of said other group of channels also extend into said passage but to a lesser extent than the inlet portions of said one group of channels.

7. The combination of claim 5, wherein said channel defining means comprises a plurality of tubes each of which defines one of said channels.

8. In a stock distribution means for delivery of an aqueous slurry in a machine for forming a paper web, a combination comprising a stock-containing stream dividing device; conduits in communication with and receiving streams of stock from said dividing device; means defining a passage communicating with and receiving said streams from said conduits, said passage having a width which equals or aproximates the width of the paper web which is formed in said machine; a slice having a discharge orifice; and means defining at least two groups of channels connecting said passage with said slice to deliver stock to said orifice, said channels being inclined with respect to said conduits and each of said channels having a stock-receiving inlet portion communicating with said passage and an outlet portion which discharges stock into said slice, the inlet portions of one group of said groups of channels communicating with said passage upstream of the inlet portions of the other group of said groups of channels and at least a portion of each channel of said one group converging toward the channels of said other group, as considered in the direction in which the stock is fed from said passage to said slice, the inlet portions of said one group of channels forming a row and said passage defining means having a stepped portion upstream of said row so that the quantity of stock flowing into the channels of said one group at least closely approximates the quantity of stock flowing into the channels of said other group.

* * * * *